United States Patent [19]

Croop et al.

[11] 4,095,557

[45] Jun. 20, 1978

[54] APPARATUS FOR MAKING ELECTRICAL COILS USING PATTERNED DRY RESIN COATED SHEET INSULATION

[75] Inventors: Edward J. Croop; Howard E. Saunders, both of Pittsburgh; Dean C. Westervelt, Acme, all of Pa.

[73] Assignee: Westinghouse Electric Corp., Pittsburgh, Pa.

[21] Appl. No.: 683,118

[22] Filed: May 4, 1976

Related U.S. Application Data

[62] Division of Ser. No. 527,458, Nov. 26, 1974, Pat. No. 3,974,302.

[51] Int. Cl.[2] ..... B05B 5/02; B05B 15/04; B05D 1/06

[52] U.S. Cl. ..... 118/301; 29/605; 118/406; 118/624; 118/630; 336/206; 427/21

[58] Field of Search ..... 118/301, 325, 406, 624, 118/629, 630; 427/14, 21, 32, 121, 177, 194; 527/458; 29/605; 101/126; 336/94, 60, 205, 206

[56] References Cited

U.S. PATENT DOCUMENTS

| | | | |
|---|---|---|---|
| Re. 22,419 | 1/1944 | Smyser | 118/630 X |
| 1,194,890 | 8/1916 | Spiegel | 118/301 |
| 1,448,203 | 3/1923 | Cumfer et al. | 118/301 |
| 3,081,698 | 3/1963 | Childress et al. | 427/21 X |
| 3,246,271 | 4/1966 | Ford | 336/94 |
| 3,613,635 | 10/1971 | Brehm | 118/406 |
| 3,934,332 | 1/1976 | Trunzo | 427/14 X |

*Primary Examiner*—Louis K. Rimrodt
*Attorney, Agent, or Firm*—D. P. Cillo

[57] ABSTRACT

A porous, electrical insulating adhesive substrate is made by (A) electrostatically coating a flexible sheet material with heat reactive adhesive resin particles, having an average particle size of between about 1 micron to 2,000 microns, the adhesive particles are applied in a predetermined pattern on the sheet covering from about 10 percent to 90 percent of the sheet material area, the area between the resin pattern not being coated; and then (B) heating the patterned coated sheet material between about 65° C to 250° C, forming a discontinuous, 0.25 mil to 25 mil (0.006 mm to 0.635 mm) thick, dry coating pattern of heat reactive adhesive particles bonded to the sheet material, said heat reactive adhesive coating covering from about 10 percent to 90 percent of the sheet material area; the patterned coated sheet may then be inserted as an oil permeable layer insulation between high voltage windings and low voltage windings and between layers of high and low voltage windings in a wound coil assembly, after which the assembly can be heated at a temperature and for a time effective to securely bond the winding layers together, and thus provide a porous, oil permeable, bonded transformer coil assembly.

14 Claims, 6 Drawing Figures

APPARATUS FOR MAKING ELECTRICAL COILS USING PATTERNED DRY RESIN COATED SHEET INSULATION

This is a division of application Ser. No. 527,458 filed Nov. 26, 1974 now U.S. Pat. No. 3,974,302, granted Aug. 10, 1976.

BACKGROUND OF THE INVENTION

In the transformer coil art, a number of methods have been adopted for holding or anchoring the turns of an electrical coil, so that they can resist movement when the turns are subjected to the flow of current and consequent electromagnetic forces tending to move them out of position. A commonly practiced method is to bond the turns of the coil to the layer insulation by the use of resinous adhesive layers or resin solution impregnated layer insulation. This method has not been entirely satisfactory, since by filling the coil with such continuous adhesive layers or completely resin solution impregnated materials, it is rendered impervious to the penetration of oil which is essential in providing high impulse strength in transformers.

To provide improved porous solidification of transformer coils, which will withstand large surges of power with resulting high mechanical stresses, Ford, in U.S. Pat. Nos. 3,237,136 and 3,246,271 has used discontinuously patterned resin solution impregnated kraft paper as the restraint. This method however averages only about a 0.25 mil (0.006mm) to 1.5 mil (0.03mm) adhesive thickness build. This low range can be inadequate in many instances for complete wire to paper bonding, providing insufficient short circuit strength. This impregnation with resin solution saturates the paper fibers under the adhesive pattern. When the patterned paper is subjected to a high humidity atmosphere, the paper surrounding the adhesive pattern can swell such that, in some cases, the adhesive pattern forms a depression and is rendered ineffective to bond coils.

Other methods of coating paper have provided thicker builds of patterned particles using dry powder or fiber application. Uhrig, U.S. Pat. Nos. 3,671,284; Brehm, 3,613,635; Meston, 3,174,328; and Bayer, 3,557,691 coat paper in a predetermined pattern. Uhrig applies a pattern of adhesive points using a dry resin powder and a hot roll applicator having suitable projection points on its surface. Brehm applies dry resin powder in the form of uniformly distributed dots, using a magnetic hopper application means and a perforated hollow roller.

Meston teaches applying discontinuous dry rayon fiber patterns on a discontinuous adhesive solution precoated moving paper sheet, using a diamond cut out pattern, in a continuous electrostatic coating method. The fibers are blown up past a positive electrode, through a mask moving parallel with and at the same speed as the paper and onto the paper which passes next to and beneath a negative electrode. Bayer coats untreated paper strips with a discontinuous dry resin powder pattern by using a stencil or cut out mask in a continuous electrostatic coating method. The powder passes through the stencil and attaches to the paper which is disposed in the air space between the stencil and a negative plate. None of these methods would appear to provide enough bonding points on both sides of the sheet material to insure adequate bonding between adjacent layers and sufficient bond strength for transformer coil layer insulation application.

What is needed then, is a method of making a highly porous yet completely bonded electrical coil, using layer insulation having a discontinuous, minimum, 0.25 mil (0.006mm), and preferably 0.5 mil to 25 mil (0.013 mil to 0.635mm) thick, dry coating pattern of adhesive particles; applied in a manner to allow oil permeation through a plurality of laminated layers after the resin adhesive is set.

SUMMARY OF THE INVENTION

Generally, the present invention comprises a method of making an electrical coil, or other type winding around a core or a conductor in an electrical apparatus, the turns of which are anchored evenly throughout the coil, so as to offer high resistance to displacement when subjected to magnetic stresses, and the body of which is completely permeable to dielectric fluid.

More particularly, the process involves; (A) applying a pattern of solid heat reactive resin particles onto a porous flexible substrate, by means of an electrostatic spray apparatus, by continuously moving the substrate between two perforated hollow cylindrical masks, each containing electrostatic spraying means therein; (B) heating the particles between about 65° C to 250° C to minimally bond them to the substrate, preferably paper; (C) forming an inner insulating tube; (D) winding insulated wire conductor coil turns and the resin particle patterned coated substrate around the inner tube, so as to provide usually at least two different windings including low voltage windings and high voltage windings; the coil windings consisting in one instance of a plurality of radially superposed layers of helically wound wire and the layers of wire being separated by inserting the resin particle, patterned, coated substrate, to form an electrical coil structure; and (E) heating the electrical coil to form a completely oil permeable intimately bonded assembly.

The resin particle, patterned, coated paper is made by electrostatically applying dry, heat reactive resin powder, preferably modified epoxy resin particles. The powder has an average particle size of between about 1 micron to 2.000 microns. The particles are heated between about 65° C to 250° C for a time effective to bond the powder to the paper, but still remain in a non-set state. The powder is applied in a pattern in an amount effective to provide between about 10 percent to 90 percent area coverage on each side of the paper and the wound electrical coil is heated between about 100° C to 220° C, to effectively cure the resin and bond the conductors to the paper and to bond adjacent paper layers. The resin coating is discontinuous, not forming a solid film. The coating is at least about 0.25 mil (0.006mm) thick.

This process provides a high strength, uniformly anchored, porous coil structure which can be used in a transformer, or other type electrical device, around a magnetic core; all immersed in a dielectric liquid contained in a tank closed with a cover. Of major importance also is the fact that no volatile solvents or air pollutants are used in making the layer insulation.

BRIEF DESCRIPTION OF THE DRAWINGS

For a better understanding of the invention, reference may be made to the preferred embodiments, exemplary of the invention, shown in the accompanying drawings, in which.

DESCRIPTION OF THE PREFERRED EMBODIMENTS

Figure 1:
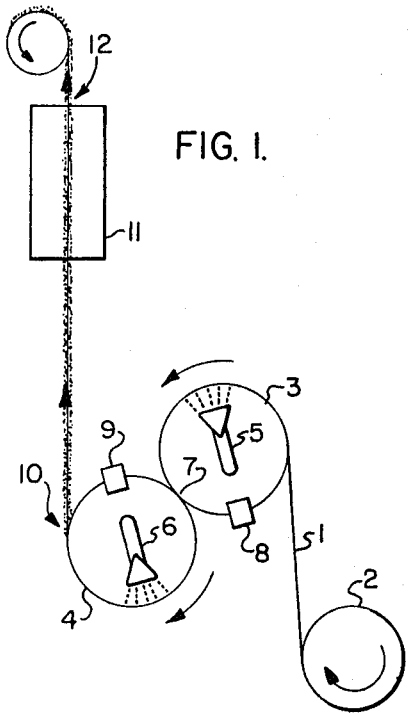
FIG. 1 shows a schematic diagram of one method of making the resin coated paper used as layer insulation in the coil of this invention.

Referring now to FIG. 1, a flexible, porous or nonporous sheet or web material 1 (about 0.25 mil to 30 mils thick), such as, for example, cellulosic sheet, for example cotton or paper, glass cloth, polyester fabric, mica paper, asbestos paper, polyamide or polyimide or polyethylene glycol terephthalate ester sheet, is used as the substrate. Preferably 1 mil to 30 mil (0.025mm to 0.75mm) crepe or kraft paper, having a moisture content between about 2 percent to 10 percent is used. Preferably the paper will be thermally stabilized and contain within its interstices an effective amount, generally about 0.02 weight percent to 5 weight percent stabilizing agent. Suitable stabilizing agents would include melamine, triethyl melamine, triphenyl melamine, diallyl melamine, tris-tertiary butyl melamine, N-tertiary butyl melamine, dicyandiamide, polyacrylamide, succinonitrile and the like. These are usually added during paper manufacturing and greatly enhance thermal stability in liquid dielectrics.

The sheet material is continuously fed from pay off reel 2, to an electrostatic spray apparatus comprising at least one mask and one spraying means. In the preferred embodiment, the sheet is fed between two perforated hollow cylindrical masks 3 and 4, containing therein electrostatic spraying means 5 and 6 capable of dispensing dry resin powder with an electrical charge.

Figure 3A:
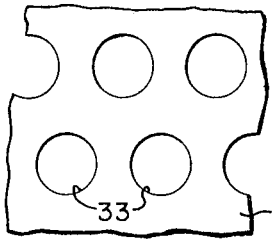
FIGS. 3(a) and (b) show several typical patterns of masks used in the method of this invention.
Figure 3B:
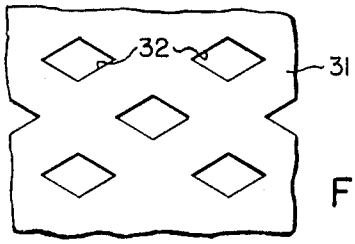
Figure 2:
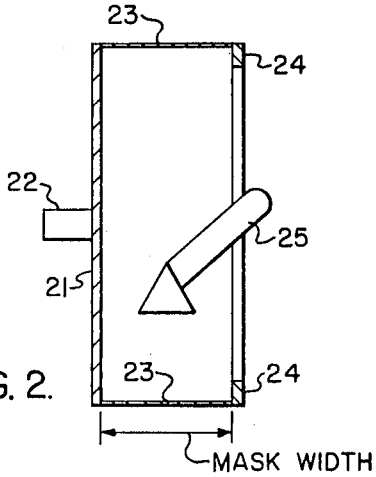
FIG. 2 is a sectional view of a mask.

Referring to FIG. 2, the masks can consist of a circular backing plate 21, having a shaft 22 welded perpendicularly to the center of the plate, with a patterned mask 23 attached outwardly from the circumference of the plate. Also shown is circular support ring 24, and electrostatic coating means 25 which would be supported and positioned at the open side of the hollow mask. The circular mask, which can be fabricated from a long metal sheet, will be welded at some point in its circumference to form an open circular wheel. Several mask patterns are shown in FIG. 3. The metal sheet 31 forming the mask can have diamond shaped openings 32, as shown in FIG. 3(b), circular shaped openings 33, as shown in FIG. 3(a), or any other type regular or staggered pattern punched out. The applied resin powder will pass through the openings and attach to the sheet material behind the patterned mask. The powder applied to the sheet material then would form a diamond or circular pattern respectively, with the two masks shown.

Referring again to FIG. 1, the cylindrical masks 3 and 4 are mounted in contact at point 7. The sheet material will generally contact about ½ to ¾, but may contact 1/10 to 9/10, of the outside circumference of each of the cylindrical masks 3 and 4. In the preferred design the set of masks are not on the same horizontal plane, one being located above the other in a configuration such that the sheet material moving between the contacting cylindrical masks will effectively rotate them by friction in the directions shown. In FIG. 1, mask 3 is driven in a counter clockwise direction and mask 4 is driven in a clockwise direction. A motor or other suitable means, however, might be attached to the shaft of either or both masks to drive them so that the flexible substrate passes between the masks.

Inside each mask wheel an electrostatic coating means 5 and 6 is mounted; generally on an external support or by other suitable means, in a manner effective to apply a resin powder along the width of the cylindrical mask. If the mask width is over about 12 inches a plurality of side by side coating means may be required. Any suitable electrostatic coating means, with an associated dry resin supply means, may be used to apply dry resin powder. For example, a 10 KV to 90 KV powder spray gun, driven by air pressure, and having a charged needle in its nozzle; or an electrostatic enclosed cloud chamber, having an opening along the mask width through which charged particles can pass, may be used.

Depending on the type of electrostatic coating means used, the sheet material will be moved between the mask wheels 3 and 4 at a speed effective to apply the dry resin powder so that it will adhere to the sheet material which shows through the cut out portions of the mask. Powder will also adhere to the inside of the patterned mask, and a suitable resin powder recovery means 8 and 9 can be used to remove excess powder. A vacuuming or brushing type unit may be used in this regard, and the extra powder reused to coat the sheet material. The sheet material emerges at point 10 having a patterned coating of resin powder particles adhering to it due to electrostatic attraction of the powder to the sheet material.

Although thermoplastic resins with reasonably high melting points i.e. between about 85° to 180° C, such as nylon, polycarbonate and polysulfone resins can be used, especially in tape applications or as an insulator around single conductors; they provide much less strength in the electrical coil under physical and thermal stress than thermosetting resins, which are preferred, especially for transformers operating at high temperatures.

The thermosetting resin particularly applicable is an epoxy resin (glycidylpolyether of a dihydric phenol). Epoxy resins are well known in the art. They are generally the reaction products of bisphenol A and epichlorhydrin, and are used in conjunction with acid anhydride, amine or amide curing agents. Epoxy resins and their preparation are throughly discussed in Brydson, *Plastic Materials,* 1966, chapter 22, herein incorporated by reference. The epoxy resin may be modified by addition of additives such as epoxy esters of dibasic acids, polyacrylates and imidazoles to improve flexibility, cure, flow, and bonding to the supporting substrate under heat. It may also contain pigments for coloring. Other suitable thermoset resins are silicone-epoxy resins, polyester resins, polyurethane resins and polyacrylic resins.

These thermosetting resins must be in dry, tackfree powder form, B-staged and remaining fusible for further processing i.e. dry, solid, but not completely cured, and capable upon further heating of being fully cured to a thermoset state. The preferred epoxy resin is a flexible resinous admixture of two different epoxy resins, an epoxy ester and a curing agent. The preferred epoxy has a melting point between about 65° to 110° C and is especially suitable for use with electrostatic spray guns or electrostatic applicator apparatus.

The preferred epoxy is made from a diglycidyl ether of bisphenol A having an epoxy equivalent weight of about 400 to 900 and a second diglycidyl ether of bisphenol A having an epoxy equivalent weight of about 750 to 1400, with a weight ratio of the first epoxy to the second of about 1 to about 12. This is mixed with about 10 wt % to 60 wt % of an organic placticizer or flexibilizer, such as, for example, an epoxy ester of a dibasic acid and with any acid anhydride, amine or amide curing agent for the epoxy, such as pyromellitic dianhydride, tetrahydrophlhalic anhydride, benzophenone tetracarboxylic dianhydride, ethylene diamine, diethylene triamine, triethylene tetramine, dimethylamine propylamine, benzyl dimethylamine, methylene dianiline and dicyandiamide. A polyacrylate flow agent, and an accelerator, such as 2-methyl imidazoledicyandiamide or a hydrazide may also be used.

The resin powder must have an average particle size of between about 1 micron to 2,000 microns (U.S. sieve size finer than about 10 mesh), but preferably between about 37 microns to 420 microns for transformer layer insulation applications. Within this particle size range, the final resin adhesive thickness after final bonding will be within the range of about 0.25 mil (0.006mm) to 25 mils (0.6mm) and preferably from about 0.25 mil to 7 mils. Particles over about 420 microns provide thick builds of resin, which when later thermoset, flow appreciably under the pressure used and do not provide adequate oil permeability for transformer coil applications. Particles under about 1 micron would tend to provide a very fine deposit which would appreciably reduce bond strength of the coated paper. For simple bonding adhesive tape applications, patterned coatings having thickness up to about 25 mils are acceptable.

The area coverage of the moving paper sheet is critical and the powder must be applied in an amount effective to provide between about 10 to 90 percent total area coverage of the insulating paper, i.e. the resin pattern will constitute 10 to 90 percent of the paper area. Area coverage below about 10 percent will appreciably reduce bond strength of the coated sheet. Area coverage above 90 percent will result in an excellent bond, but due to melt flow during later pressure bonding may produce an oil impermeable film on the paper. The preferred area coverage is between about 15 to 50 percent. Area coverage can be measured by comparing coated paper with available standard area coverage charts.

The individual pattern resin areas should preferably be uniformly distributed over the substrate. Regardless of the shape of the patterned bonded powder area, the distance from any part in the area to the nearest edge thereof must not exceed 2 inches. The area should preferably range between about 1.75 sq. in., as in a 1½ in. diameter circle, to about 0.003 sq. in. as in a 1/16 in. diameter circle. Where the powder area per individual powder application is less than 0.0125 sq. in., the final bond between the treated insulation and conductors or between layers of treated insulation is not strong enough under stress. The individual resin powder areas on the substrate will correspond with the mask openings.

The powder coated cellulosic sheet, having a speed of between about 2 ft/min to 120 ft./min (3.3 ft/min to 39.6 m/min), preferably 15 ft/min to 70 ft./min (4.95 m/min to 23.1 m/min), having passed between the masks 3 and 4, passes through heating means 11. This can be an oven having minimal air flow or an infrared radiant heater, providing a temperature of between about 65° C to 250° C, but preferably 145°–180° C at the substrate surface. This provides a particle temperature of about 65° C or higher. This heating step bonds the powder particles to the sheet.

The powder coated paper, as it exits the heater at point 12, should have at least a 0.25 mil (0.006mm) layer of heat reactive resin adhesive particles on each side of the sheet. These layers should not be over about 7 mils thick when the patterned sheet is to be used as layer insulation in oil filled transformers. The coating must be patterned, preferably on both sides, with an adhesive particle patterned, projection point area coverage of between about 10 percent to 90 percent of the paper. When a thermoset resin is used it will be in a B-stage, fusible but dry to the touch. The coating should not be melted to the extent that a solid film or nearly solid film is produced.

Initially the particles are of irregular shape, but after heating according to the method of this invention the particles smooth out and flow a small amount to form lenticular tear shaped particulate shapes. The particles are not melted to the extent that substantial flow has caused a fused film to be formed between patterned projections. This provides a powder coated sheet which is highly porous yet provides a substantial area of resin adhesive projection points and contact areas. When a maximum area coverage of 90% is used on each side, there will still be sufficient area of uncoated paper for oil permeation.

To achieve the type porosity of the coated paper and adequate bonding of the particles to the paper required for transformer layer insulation, the web speed of the paper through the heating means must be adjusted within the 2 to 120 ft./min limit; so that the resin particles are neither underheated, not bonding to the paper, nor thermoset. At sheet speeds above about 75 ft./min, banks of heaters or an extended oven would probably be required to provide adequate adhesive powder bonding.

The cellulosic sheet with bonded powder coating may then be wound onto a takeup reel by any suitable means after heating. Of course the resin coating composition and state of cure must be such that the paper will not block or stick on the takeup reel in a dry or humid atmosphere.

When thermoset resins are used, the particles, as they exit from the heating means must be in the non-set state. Then, when the coated paper is applied between the wire coil layers in a transformer, the resin particles, contacting the wire coils or resin particles on an adjacent particle coated paper layer, can be heated to a final thermoset state. Thermosetting securely bonds the paper to paper layers or paper to coil layers together, preventing any movement due to electrical stresses, while still maintaining an oil permeable discontinuous particulate layer of between about 10 percent to 90 percent area coverage on the paper. Little or no uncoated paper area is lost in the thermosetting or final bonding of the coil.

The resins used must, of course, be compatible with transformer oil if the tape is to be used in transformer oils, and must not be soluble or degraded to any appreciable extent in hot transformer oil. The resin used in this process does not deeply penetrate the support substrate surface, since it is applied in dry form and is not appreciably melted. Therefore, the paper under the resin pattern area is not impregnated and is free to act as a wick for oil permeation. The oil then has a free paper volume to permeate throughout the tape length. Also, since the paper is uniformly free of impregnant, in a humid atmosphere the tape will swell evenly rather than just between the applied patterned resin areas, thus assuring that the resin projections will remain above the paper, and the tape will retain good bonding characteristics.

The patterned particle coated paper is then wound on a mandrel to form a central inner insulating tube of a plurality of layers. Low voltage windings are then wound on the inner tube, the winding being of a plurality of copper or aluminum flat foil layers or radially superposed layers of helically wound round or rectangular copper or aluminum wire, insulated with, for example, a resinous enamel such as polyvinyl formal, epoxy, polyimide, polyamide, polyamide-imide, polyester, polyester-imide, acrylic, polyurethane or any other suitable magnet wire enamel. The size of the conductor employed will depend on the specification of the coil and the duties which it has to perform. The patterned, particle coated paper is simultaneously wound with the low voltage windings, providing layer insulation between adjacent layers of the winding, layers of wire being separated from each other by the resin particle coated paper.

Figure 4:
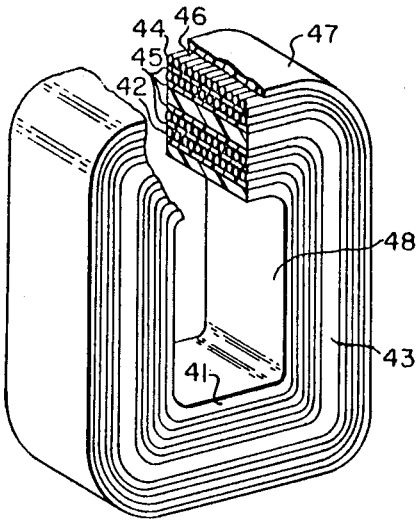
FIG. 4 is a sectional three dimensional view of the windings of a transformer made in accordance with the method of this invention.

In a similar fashion, a high voltage winding is wound simultaneously with the patterned particle coated paper, providing layer insulation between adjacent layers of the winding, layers of wire being separated from each other by the resin coated paper. After the inner low voltage windings and high voltage windings are completed an outer low voltage winding may be added. A spacer consisting of a plurality of layers of particle coated paper may be wound between the low and high voltage windings as shown in FIG. 4, where the inner insulating tube is shown as 41, one of the low voltage windings is shown as 42 and the spacer is shown as 43.

In the case where magnet wire is used as the windings, the individual wires are insulated and each layer separated by the patterned layer insulation. This is also the case with uninsulated flat metal foil used as the coil windings. Where flat insulated metal foil is used, the layer insulation need not be used to separate each adjacent foil winding, and it is to be understood in this case that a plurality of up to 4 foils will be considered as one winding.

The high and low voltage windings may, in addition, be further separated by duct forming spacers, not shown in the drawing, such as fiber or wooden strips, corrugated fibrous sheet or the like, so that oil can actually flow between the various sets of windings. The number of duct sections will vary depending on cooling requirements at the particular transformer rating. In FIG. 4, one of the high voltage windings is shown as 44 and the layers of interdisposed layer insulation of resin particle coated paper are shown as 45. The plurality of radially superposed layers of helically wound wire comprising one of the windings is shown as 46 with outer layer of resin coated paper as 47. A core formed of any suitable magnetic material is placed in space 48, in the center of the electrical coil.

The wound coil assembly can then be placed in an over or other suitable heating means at a temperature and for a time effective to securely bond the whole assembly by melting the powder to a semifluid which will not flow appreciably if thermoplastic powder was used, or thermosetting the resin if the powder used was a preferred thermoset powder. The transformer coil is then cooled and the adhesive hardens and bonds the various layers of the transformer coil together to form a solid, uniformly bonded, oil permeable coherent unit. This step must not substantially alter the 10 to 90 percent powder coverage of the paper. The curing or thermoset temperature can vary from about 100° C to 220° C for about 1 minute to 6 hours, preferably 30 minutes to 180 minutes.

It is critical in this final bonding step that the bonded resin particles remain in substantially the same patterned projection point form with substantially the same area coverage of the paper as before curing or thermosetting. The resin adhesive particles will adhere to each other, to the paper and to the wire and bond the paper to the insulated magnet wire layers and adjacent paper layers and then set, preventing almost any movement of the wire and paper layers under stress particularly when a thermoset resin is used. The would coil assembly is then placed in its transformer container where a vacuum oil impregnation process takes place. A liquid insulating material, such as cable or transformer oil, is employed preferably in heated and deaerated form as the impregnant.

One suitable oil, for example, would contain about 10 weight percent aromatics, have a viscosity index of about 77 and a specific gravity at 16° C of 0.88 to 0.90. Generally, mineral oils obtained from the heavy distillates fraction of crude petroleum are the most widely used insulating liquids. The unsaturated constituents which would result in poor oxidation stability are removed from the distillate. Care must be taken to prevent removal of all the aromatic hydrocarbon content. This is important for its contribution to oxidation resistance and the ability of the oil to absorb hydrogen whch might be liberated by electric discharges in the oil. Small amounts of inhibitors, such as ditert-butyl-p-cresol are added to improve oxidation stability. These oils have low dielectric constants, about 2 to 2.5 and low power factors, less than about 0.1%.

A vacuum of about 2mm of Hg is drawn on the tank containing the wound coil assembly and the oil is introduced. The pressure of 2mm is held from 4 minutes to 15 minutes depending on the size of the coil until all gas evolution from the coil assembly ceases. At this time the vacuum is generally removed and the pressure in the tank restored to atmospheric pressure. The preferred method is to bond the coil prior to oil impregnation, since not only the oil but the transformer components would have to withstand the heat if the particles were thermoset in the transformer. Also, bonding before impregnation would remove most of the moisture from the coil allowing better oil permeation.

Figure 5:
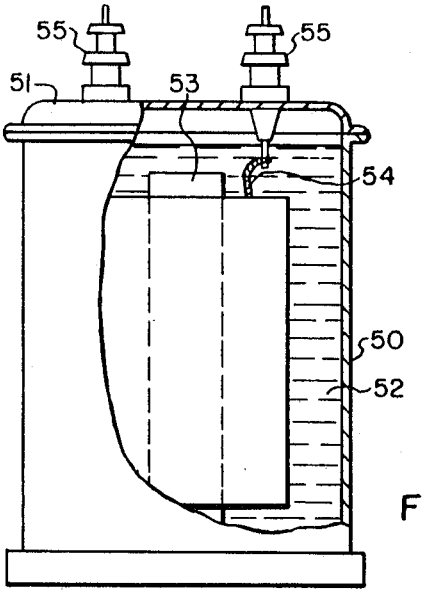
FIG. 5 shows in side elevation, a transformer with a portion cut away to show a coil embodying the invention as it is mounted and immersed in oil.

Referring now to FIG. 5, the coil structure of FIG. 4 is operatively assembled in a transformer which comprises a tank 50, closed by a cover 51 and containing dielectric liquid 52 such as mineral oil or the like. In the transformer the coil structure encircles magnetic core 53. The high and low voltage leads, one of which is shown as 54 are respectively connected to corresponding bushings 55 mounted on the cover.

While the method of this invention is primarily drawn to making oil cooled distribution transformers, where the patterned resin adhesive particle coated paper is used as the layer insulation, other uses are possible. The coated paper could be engaged as layer insulation for an electrical conductor-insulation combination in a bonded electrical apparatus. The patterned particle coated paper, coated only on one side could also be used, for example, as an outer tape wrapper of a conductor configuration in various types of electrical apparatus or to bond 0.1 to 1.3 million voltamperes pancake coils for large power transformers.

EXAMPLE 1

Ten mil (0.5mm) thick 12 inch wide kraft paper, having a moisture content of about 5 to 10 percent, and containing about 1 to 3 wt. % thermal stabilizing agent, was coated to a thickness of about 8 mils (0.2mm) total, 4 mils on each side of the paper, with a modified bisphenol A epoxy resin powder. The paper was coated using an apparatus substantially as shown in FIG. 1 of the drawings, comprising a paper roll, two perforated hollow cylindrical masks containing one electrostatic spray gun each and a vertical heater.

The paper was continuously fed from a paper roll, at a web speed of about 15 ft/min, around and between two coating wheels. Each coating wheel consisted of a 3 ft. diameter ¼ in. thick aluminum backing plate with a 12 in. long × 1 in. diameter shaft welded perpendicularly to the center of the backing plate. In run (a), a steel mask approximately 9½ ft. long, 12 in. wide and 1/16 in. thick, with a pattern of ⅜ in. diameter circles punched out, on 9/16 in. staggered centers with a punched out area of about 40%, was attached to the backing plate to form a 3 ft. diameter cylinder 12 in. deep. In run (b) a similar mask but with ⅛ in. diameter circles punched out on 7/32 in. staggered centers from a 3/16 in. sheet was used.

The two ends of the mask were welded together where they joined. The cylinder was supported at the edge opposite to the backing plate by means of an aluminum ring ¼ in. thick and 1 in. wide. The two coating wheels were mounted in contact by means of the 1 in. diameter shafts. They were horizontally offset, one being located above the other so that the paper contacted about ⅝ of the circumference of the first contacting mask and about ⅝ of the circumference of the second contacting offset mask as shown in FIG. 1 of the drawings. This configuration allows the paper moving between them to rotate the masks by friction, the first mask rotating in a counter clockwise direction and the second mask in a clockwise direction. The paper was pulled through the masks by a motor driven capstan and a motor driven take up reel.

The movement of the paper through the apparatus drove the wheels exactly in synchronization with each other and the paper. Inside each coating wheel a Nordson electrostatic powder spray gun was mounted on external supports, so that the charged powder sprayed from the gun completely covered the width of the mask. When the paper was moved, the paper and mask were continuously and completely coated by the charged powder adhering to both substrates. The powder was removed from the mask shortly after the mask had rotated away from the paper. A combination of brushing and vacuuming was used to remove this excess powder, which could be re-used to coat the paper.

After the paper had separated from the mask, the masks' punched out pattern was exactly reproduced on the paper by the charged powder. When both sides of the paper had been so coated, the paper was passed vertically through a 6 foot high wire enameling oven where the powder was fused to obtain a permanent pattern of resin on the paper. The paper from run (a) and (b) had a dry pattern of resin areas on both sides with substantially no resin particles between the resin pattern areas. The resin pattern areas coated in run (a) were about 4 mils thick and of about ⅜ inch diameter, covering about 40% of the paper area. The resin pattern areas coated in run (b) were about 4 mils thick and of about ⅛ inch diameter, covering about 30% of the paper area. This provided individual pattern areas of 0.11 sq. in. for sample (a) and 0.01 sq. in. for sample (b). The coated paper was then wound into spools by the take-up and did not stick or block.

The resin was a modified epoxy resin having a melting point of about 65° to 100° C. The resin was in dry powder form having a maximum particle size of about 74 microns (200 mesh), and was capable of being heated to a thermoset state. The resin consisted of an admixture of 2 separate epoxies. One epoxy was a diglycidyl ether of bisphenol A having an epoxy equivalent weight of about 400 to 900. The other was a diglycidyl ether of bisphenol A having an epoxy equivalent weight of about 750 to 1400. These epoxy resins were modified by addition of about 40 wt % of an epoxy ester of a dibasic acid flexibilizer, such as $COOH—C_xH_y—COOH$, where $y = 2x$, and $x =$ about 30 to 40. This composition also contained small effective amounts of polyacrylate flow agents, dicyandiamide curing agent, and imidazole accelerator.

Both the 40% and 30% patterned resin coated papers were incorporated into transformer coils by winding insulated copper electrical conductors into turns around an inner insulating tube, made of a plurality of the coated paper turns, to form a low voltage winding, a high voltage winding and an outer low voltage winding. The resin coated paper was inserted as the electrical insulating material between the low and high voltage windings and between each layer of the low voltage winding and the high voltage winding. This formed 25KVA transformer coils similar to that shown in FIG. 4 of the drawings.

After the coils were wound they were heated at 135° C for about 4 hours, to advance the modified epoxy resin adhesive to the thermoset state and permanently bond the layer windings into a solid coil leaving interstices for complete oil penetration. The transformer coils were then placed in transformer oil. The oil was refined mineral oil and contained essentially no additional free moisture, inorganic acid, alkali or free sulfur. It had a dielectric strength (0.1 inch gap) of about 30 KV min., a power factor (60 cycle 25° C) of about 0.05% max., a viscosity (SSU 37.8° C) of about 62 sec., and a specific gravity at 15.5° C of about 0.898.

While the coils were in oil in the transformer assembly at room temperature, ionization and temperature rise tests were run. In the ionization test, the coils were connected to a variable high voltage source and voltage increased until ionization was detected. The results showed that ionization commenced at a high voltage level, because the paper barrier layers were thoroughly saturated with the oil, and provided an excellent transformer insulation system. In the temperature rise test, voltage was impressed across the coils while they were still immersed in the oil, and the temperature increased only a small amount and only within a level acceptable to operation of the transformers. In this test about 7200 volts were impressed across the high voltage windings and 240 volts across the low voltage windings. At a 100% load of 3 amps, the temperature of the oil immersing each transformer only increased from 25° to about 47.5° C. The oil saturated transformer coil was then taken out of the oil and subjected to mechanical loading tests designed to produce telescoping of the coil layers. In this test metal mandrels were inserted between 2 layers of the low voltage windings and high voltage windings in each transformer.

A force of about 6700 pounds was required to displace the inner low voltage coils and a force of about 6090 pounds, applied by a press onto the stationary mounted coil, was required to displace the middle high voltage coils. This is a force about 10 times more than that required in prior art low voltage coils, using dried 0.25 mil thick amine cured resin patterned biphenol A epoxy solution coated on one side of 10 mil kraft paper as the low voltage layer insulation. Additionally, it was determined that failure occurred by tearing and delamination of the paper rather than by interlaminar slippage as with the patterned varnish coated paper.

This method of coating the paper substrate provided improved bond strength both at room temperature and at elevated temperatures, excellent oil permeability, excellent resin retention on the paper surface, resistance to oil degradation at high temperatures, and used no volatile solvents or air pollutants.

This patterned adhesive coated substrate would also lend itself to bonding oil duct sticks to the paper, and could allow an automated method to replace the present messy, time-consuming hand operation, where a varnish is painted on each duct stick. The coated restraints can be used to bond pancake coils for large power transformers when used as an outer bonding conductor wrapper. The patterned coated paper is particularly useful as a bonding tape for high humidity environments since it swells uniformly and not just between the resin patterns and so retains its contact surface and bond strength.

EXAMPLE 2

A variety of 10 mil thick, one inch wide kraft paper samples, having a moisture content of about 5–10 percent, and containing about 1 to 3 wt. % thermal stabilizing agent were coated with the resin particles described in Example 1 using the same apparatus, spraying techniques, and paper speed as in Example 1. The samples were coated on both sides to a thickness of about 2.5 to 3 mils total, 1.25 to 1.5 mils on each side of the paper. Both ⅜ in. diameter circles, sample (a) providing a 40% coated area, and ⅜ in. diameter circles, sample (b) providing a 30% coated area were used. The tensile shear strengths of 2 inch × 4 inch samples were tested. The test specimen construction consisted of four 2 inch × 4 inch layers of coated paper stacked and sandwiched between the ends of two 10 mil thick aluminum strips 2 inches wide and 6 inches long. Test pieces were bonded for 6 hours under pressure of 50 lb/sq. in. and cured at 140° C.

Tensile shear bond values were obtained by using a floor mounted Universal Tensile Testing Instrument, model TTC, manufactured by Instron Corporation, with an incorporated oven in which the samples were mounted. One end of each sample was fixed to the base of the oven and the other to a clamping device with a rod extending through the top of the oven to the testing machine. The test results are set out below:

| Sample | Total Build (mils) | Area Coverage (% particles) | Ave. Tensile Shear Strength (lb/sq. in) 100° C |
|---|---|---|---|
| 2a | 2.5 | 40 | 63.0 |
| 2b | 3.0 | 30 | 56.0 |

This example showed excellent tensile shear strength retention at elevated temperatures similar to those found in a short circuit transformer environment.

I claim:

1. An apparatus for making a flexible, patterned, porous, adhesive coated substrate comprising:
   (A) at least one rotatable perforated hollow cylindrical mask, containing patterned openings, each perforated opening having an area of up to about 1.75 sq. in., where the distance from any part in the perforated area to the nearest perforated area edge does not exceed 2 inches, the mask having electrostatic coating means therein, capable of dispersing dry, heat reactive adhesive resin powder through the patterned openings;
   (B) means to pass a flexible substrate next to and in contact relationship with the mask, the substrate being capable of having the resin powder applied thereto through the patterned openings in the mask, wherein the coating means is effective to provide between about 10 percent to 90 percent area coating coverage of the substrate with the resin powder, said substrate contacting between about 1/10 to 9/10 of the outside circumference of the mask and;
   (C) means to heat the substrate after it has passed next to the mask.

2. The apparatus of claim 1, wherein there are two masks, each having coating means therein and the substrate passes between them, wherein the masks contact each other and rotate in opposite directions when the substrate is passed between them.

3. The apparatus of claim 2, wherein the substrate contacts about ½ to ¾ of the outside circumference of each mask and passes the masks at a speed of between about 2 ft./min. and about 120 ft./min.

4. The apparatus of claim 3, wherein the masks are rotated by friction with the substrate passing between them, the masks being horizontally offset, one being located above the other, and each of the patterned openings has an area between about 0.003 to 1.75 sq. in.

5. The apparatus of claim 4, also containing a resin powder recovery means within each mask.

6. The apparatus of claim 4, wherein the coating means is an electrostatic spray apparatus.

7. The apparatus of claim 4, wherein the coating means is an electrostatic enclosed cloud chamber.

8. The apparatus of claim 3 wherein the masks are driven by a motor.

9. An apparatus for making a flexible, patterned, porous, adhesive coated substrate comprising:
   (A) two rotatable perforated hollow cylindrical masks, each containing patterned openings, each perforated opening having an area of between about 0.0125 sq. in. and 1.75 sq. in., where the distance from any point in the perforated area to the nearest perforated area edge does not exceed 2 inches, the masks having electrostatic coating means therein, capable of dispersing dry, heat reactive adhesive resin powder through the patterned openings;

(B) means to pass a flexible substrate next to and in contact relationship with each mask at a speed of between about 2 ft./min. and about 120 ft./min., the substrate being capable of having the resin powder applied thereto through the patterned openings in the mask, wherein the coating means is effective to provide between about 10 percent to 90 percent area coating coverage of the substrate with the resin powder, said substrate contacting between about 1/10 to 9/10 of the outside circumference of the mask, and the masks being rotated by friction with the substrate passing between them and;

(C) means to heat the substrate after it has passed next to the mask.

10. The apparatus of claim 9, wherein the substrate contacts about ½ to ¾ of the outside circumference of each mask, and the masks contact each other and rotate in opposite directions when the substrate is passed between them.

11. The apparatus of claim 9, wherein the masks the masks being horizontally offset, one being located above the other and wherein the coating means is an electrostatic spray apparatus.

12. The apparatus of claim 9, also containing means to roll up the substrate after it has been heated.

13. The apparatus of claim 9, also containing a resin powder recovery means within each mask.

14. The apparatus of claim 9, wherein the coating means is an electrostatic cloud chamber.

* * * * *